United States Patent [19]

Greer

[11] Patent Number: 4,583,604

[45] Date of Patent: Apr. 22, 1986

[54] ROLLER REAMER WITH ROTATABLY POSITIONED BEARING BLOCK

[75] Inventor: Richard L. Greer, Houston, Tex.

[73] Assignee: Hytech International, Inc., Houston, Tex.

[21] Appl. No.: 663,301

[22] Filed: Oct. 19, 1984

[51] Int. Cl.[4] ..... E21B 10/30; E21B 17/10

[52] U.S. Cl. ..... 175/346; 175/325; 308/6 A

[58] Field of Search ..... 175/323, 324, 325, 344–347, 175/406, 407; 166/173; 308/4 A, 6 A

[56] References Cited

U.S. PATENT DOCUMENTS

| | | | |
|---|---|---|---|
| 2,172,762 | 9/1939 | Koppl | 175/347 |
| 2,199,693 | 5/1940 | Catland | 175/346 |
| 3,042,125 | 7/1962 | Duncan | 175/325 X |
| 3,303,900 | 2/1967 | Kloesel, Jr. et al. | 175/406 X |
| 3,627,068 | 12/1971 | Wagnon | 175/347 X |
| 3,680,646 | 8/1972 | Hughes | 175/323 |
| 3,907,048 | 9/1975 | Gray | 175/325 |
| 4,190,124 | 2/1980 | Terry | 175/406 |
| 4,226,291 | 10/1980 | Spelts | 175/325 |
| 4,231,437 | 11/1980 | Swersky et al. | 175/325 |
| 4,262,760 | 4/1981 | Allison et al. | 175/347 |
| 4,428,626 | 1/1984 | Blau et al. | 308/4 A |
| 4,508,184 | 4/1985 | Hansen | 175/346 |

FOREIGN PATENT DOCUMENTS

| | | | |
|---|---|---|---|
| 2081346 | 2/1982 | United Kingdom | 175/325 |

*Primary Examiner*—Stuart S. Levy
*Assistant Examiner*—Thomas R. Hannon
*Attorney, Agent, or Firm*—Mason, Fenwick & Lawrence

[57] ABSTRACT

A roller reamer for an earth boring tool is provided in which rollers are carried by shafts in pockets in the reamer body. The shafts are supported in bearing blocks which have segmental cylindrical surfaces at their widths, and a relatively shorter length as measured along the axis of the opening in the block for the shaft. The bearing blocks are passed through an entryway communicating the pocket with a recess adjacent the end of the pocket. The bearing block is passed through the entryway in a position transverse to its operative position and into the recess, and is then rotated in the recess, by cooperation of the cylindrical walls of the bearing block and mating cylindrical walls of the recess, to the operative position. The movement of the bearing block is readily achieved since it has a clearance fit with the recess to permit free assembly and disassembly of the bearing block.

20 Claims, 4 Drawing Figures

ROLLER REAMER WITH ROTATABLY POSITIONED BEARING BLOCK

BACKGROUND OF THE INVENTION

The present invention relates to roller reamers, used in connection with earth boring tools such as are used in oil and gas drilling.

Roller reamers are typically used in drill strings, behind a drill bit for earth boring and drilling. The reamer has an elongate, generally cylindrical body. The reamer body is provided with a plurality of circumferencially spaced pockets: three or four are typically provided, and in each of the pockets there is provided a roller, which may have teeth on it, the purpose of the roller reamer being to enlarge or maintain the size of the bore hole and to stabilize the position of the drill bit, and therefore its direction. For this reason, the roller reamer is also designated as a stabilizer.

The rollers are journalled on shafts, and the shafts, in turn, are supported in bearing blocks which are carried by the reamer body. Typically, slots extend in the reamer body generally axially, above and below the pocket, and the bearing blocks are positioned in the slots. Since the centrifugal forces produced by rotation of the drill string tend to cause the bearing blocks to move radially outwardly, provision is made to prevent such radial outward movement.

Wagnon, et al., U.S. Pat. No. 3,627,068, discloses a roller reamer construction of the above described type, in which the slot for the bearing block is undercut, and the bearing block has flanges entering into the undercut portion of the reamer body. The slot is axially elongated, so that the bearing block may be moved away from the pocket, to permit introduction of the shaft and roller into the pocket, after which the bearing block is slid downwardly to telescope over the end of the shaft. A screw is threaded into the reamer body, to prevent movement of the bearing block away from the roller pocket.

Blau, et al., U.S. Pat. No. 4,428,626, discloses a reamer or stabilizer construction in which wear pads are provided with outwardly extending flanges which engage in an undercut portion of the stabilizer body, to prevent radial outward movement or "throwing" of them when the drill string is rotated.

Kloesel, Jr., et al., U.S. Pat. No. 3,303,900, and Terry, U.S. Pat. No. 4,190,124, disclose down-hole tools in which removable parts are joined by a dove tail connection.

Allison, et al., U.S. Pat. No. 4,262,760, provides a construction in which a bearing block is of generally cylindrical configuration, and is positioned in a corresponding cylindrical recess in the reamer body, with the axis of the recess and bearing block extending substantially radially of the reamer body. The bearing block engages the recess with an interference fit, and screws are additionally provided to secure the bearing block in place. Removal of the bearing block is achieved with a special tool, after removal of the screws.

Gray, U.S. Pat. No. 3,907,048, provides a stabilizer in which bearing blocks are friction fit into recesses in the stabilizer body, and are then additionally secured by screws or welding.

The prior art stabilizers have been difficult to assemble and disassemble, particularly with reference to the bearing blocks. Typically, as is given in some of the foregoing examples, there is a friction or interference fit between the bearing block and a corresponding slot or recess in the reamer or stabilizer body. For placement of the bearing block in position, or for removal of the bearing block from the reamer or stabilizer body, there is typically required the application of substantial force, and the utilization of two workmen. Either hammers or hydraulic tools are used to place the bearing blocks in position or remove them, thus requiring additional labor expenses and substantial forces to perform these operations; in some instances, additional equipment such as hydraulic tools are utilized, thereby adding to the expense of the assembly and disassembly of such roller reamers and stabilizers.

SUMMARY OF THE INVENTION

The present invention is directed to a roller reamer having a reamer body provided with one or more pockets, and a roller positioned in each pocket, the roller being carried on a shaft, and the shaft supported by bearing blocks mounted in the reamer body. The reamer body is provided with a recess at the end of the pocket, with a relatively narrow entryway communicating the recess and the pocket, the recess having a width transverse of the axial direction greater than the entryway, and being provided with segmental cylindrical walls at the widest part. The bearing block is of conforming shape to the recess, having mating cylindrical walls, and having a length in the direction of the shaft opening therein which is no greater than the width of the entryway. The bearing block is positioned transversely of its normal position, that is, with the shaft opening therein extending approximately normal to its operative position, and in this position is passed through the entryway and into the recess, where it is rotated ninety degrees so that the shaft opening extends substantially axially. Interengaging means, such as flanges on the bearing block and undercuts in the reamer body, prevent outward throwing of the bearing blocks. The walls defining the recess in the reamer body and the bearing block have a clearance fit, which permits ready assembly and disassembly, more particularly the clearance fit permitting free rotational movement of the bearing block in the recess.

[illegible]ng the objects of the present invention are to [illegible] a roller reamer construction in which the parts may be readily assembled and disassembled, and to provide such a roller reamer construction which will prevent movement of the bearing block after assembly; yet another object of the present invention is to provide such a roller reamer in which there is secure attachment of the bearing block to the reamer body.

Yet another object of the present invention is to provide a roller reamer which may be assembled or disassembled without requiring large forces, plural workmen, and a further object is the provision of such a roller reamer in which all of the parts, including the shaft, will be held securely in position, but may be readily removed.

Other objects in many of the attendant advantages of the present invention will be readily understood from the following specification, drawings and claims.

DESCRIPTION OF THE PREFERRED EMBODIMENT

Figure 1:
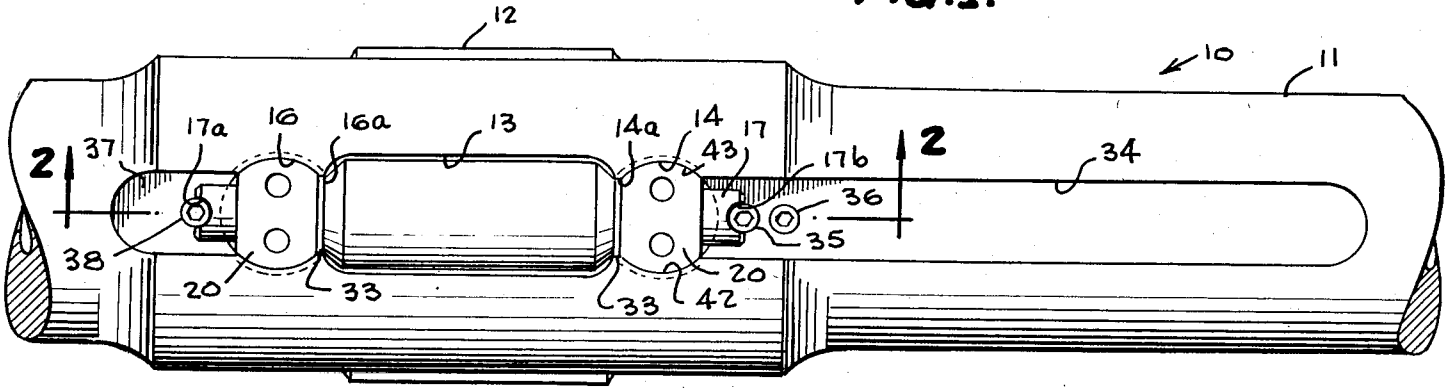
FIG. 1 is an elevational view of a portion of a roller reamer in accordance with the present invention.

Referring now to the drawings, wherein like or corresponding reference numerals are used for like or corresponding parts throughout the several views, there is shown in FIG. 1 a roller reamer generally designated 10 and comprising a generally tubular body 11 having a plurality of rollers 12 of known construction mounted therein. Each roller 12 is supported in a pocket 13. The roller 12 is generally cylindrical, having truncated ends, and the pocket 13 is of generally similar configuration. At each end of the pocket 13 there is provided a recess 14, 16, the pocket 13 communicating with the recesses 14 and 16 through relatively narrow entryways 14*a* and 16*a*.

Figure 2:
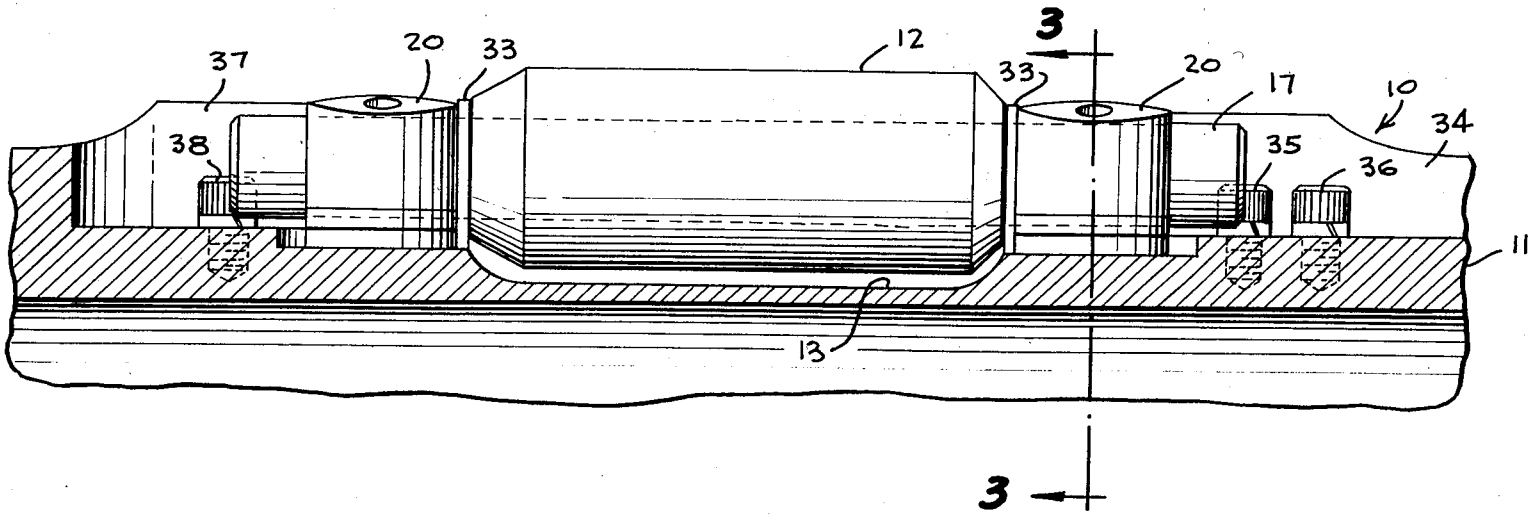
FIG. 2 is a cross sectional view, with parts in elevation, taken on the line 2—2 of FIG. 1.
Figure 4:
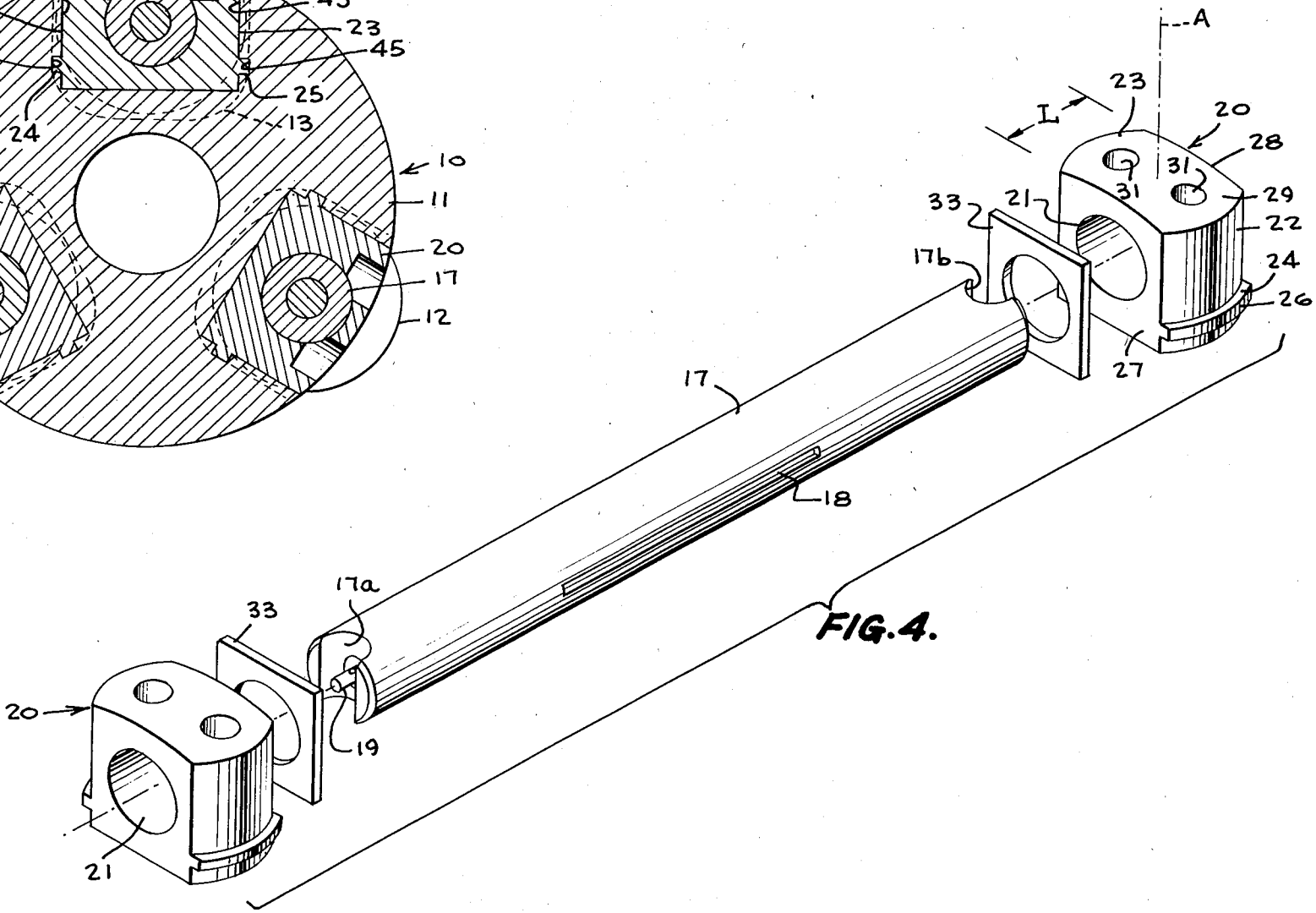
FIG. 4 is an exploded perspective view of the shaft, thrust washers and bearing blocks forming a part of the roller reamer as shown in FIG. 1.

Referring to FIG. 2, there may be seen the roller reamer 10 and the body 11, with the roller 12 supported in the pocket 13 on a shaft 17. In each end of the shaft 17, as shown in FIGS. 1 and 4, there is a radial groove 17*a*, 17*b*. The shaft 17 extends through a pair of bearing blocks 20, of identical construction. Referring to FIG. 4, each of the bearing blocks 20 may be seen to have a shaft opening 21 extending through it, and having a length L in the direction of the opening 21 which is shorter than the width, transverse to the opening 21. The bearing block 20 is provided at its width with cylindrical surfaces 22 and 23 having as their center an axis A which extends substantially perpendicularly to the axis of the opening 21. Extending from the wall 22 is a flange 24, which also has a cylindrical surface 26 and which is concentric with the axis A. The bearing block 20 is further bounded by a pair of flat surfaces, the surface 27 being shown in FIG. 4, there being a parallel surface 28 not visible in FIG. 4. As is apparent from FIGS. 1 and 4, the width of the bearing block 20, transversely of opening 21 and defined by the cylindrical surfaces 22 and 23, is greater than the length L, defined by the body between the surfaces 27 and 28.

Extending into the bearing block 20 from the upper surface 29 thereof are a pair of blind bores 31.

The shaft 17 may contain a lubricating system, not shown, for supplying lubrication to the adjacent surfaces of shaft 17 and the roller 12, and to that end may be hollow, with a lubricant discharge slot 18 therein. A pin 19 may extend from the end of the shaft 17, forming part of a lubrication system within shaft 17. Thrust washers 33 are provided on the shaft 17, bearing against the surface 27 of bearing block 20, and having width substantially the same as the width of the surface 27. As shown in FIG. 1, the thrust washers 33 occupy the entryways 14*a* and 16*a* communicating the pocket 13 and the recesses 14 and 16.

As shown in FIG. 1, the recesses 14 and 16 are of substantially conforming size and shape to the bearing blocks 20. Thus, the recesses 14 and 16 are each provided with segmental cylindrical surfaces 42 and 43 which are in mating engagement with the cylindrical surfaces 22 and 23 of the bearing block 20.

Figure 3:
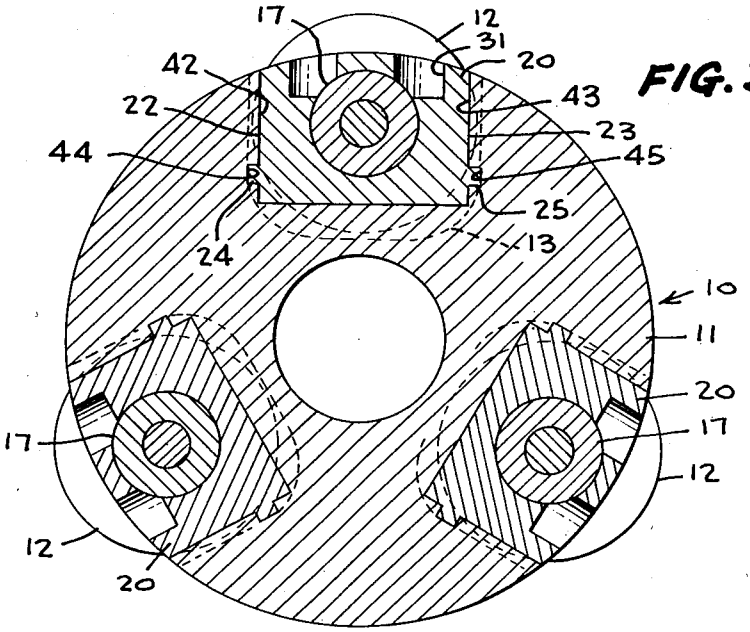
FIG. 3 is a cross sectional view taken on the line 3—3 of FIG. 2.

Referring to FIG. 3, the three rollers 12 are shown, as are the bearing blocks 20 and the shafts 17. The segmental cylindrical surfaces 42 and 43 of the recess 14 are shown engaged by the segmental cylindrical surfaces 22 and 23 of bearing block 20; the recess 14 is provided with an undercut 44 to receive a flange 24, and is also provided with an undercut 45 to receive a flange 25 which is substantially identical to the flange 24.

In FIGS. 1 and 2, to the right of the recess 14 there is a slot 34 having a length slightly greater than the length of the shaft 17. In the slot 34 there may be seen a capscrew 35 threaded into the reamer body 11, with its head in the groove 17*b* of shaft 17. A second capscrew 36 is provided, to be engaged by shaft 17 should the capscrew 25 break or become loose and fall out of the reamer body 11. The capscrew 35, since it extends into and engages the groove 17*b*, prevents rotation of shaft 17. Adjacent recess 16, which is identical to the recess 14, there is a slot 37; a capscrew 38 in slot 37, is threaded into the reamer body 11 and engages the radial groove 17*a* in shaft 17, also to prevent rotation of shaft 17.

To assemble the roller reamer 10, a bearing block 20 is positioned in a pocket 13 with the opening 21 extending transversely of the normal position; that is, the bearing block 20 is at right angles to the position shown in FIG. 1. Because the length L of the bearing block 20 along the shaft opening 21 is slightly less than the entryway 16*a*, the bearing block 20 may be moved to the left as shown in FIG. 1, into the recess 16. It is then rotated on an axis which is a radially extending axis of the reamer body 11, the segmental cylindrical surfaces 22 and 23 matingly engaging the segmental cylindrical surfaces 42 and 43 of the recess 16. Further, the flanges 44 and 45 will enter, respectively, the undercuts 24 and 25. The dimensions and tolerances of the aforementioned parts are such that there is a clearance fit between the recess 16 and its undercuts and the bearing block 20 and its flanges, and as a consequence, the rotary movement will be freely accomplished, by one person, and without resort to heavy hammers or hydraulic tools. A hand tool may be employed, engaging the bearing block 20 through the blind bores 31. The second bearing block 20 is moved through the entryway 14*a* in the same manner, is then rotated through ninety degrees, and thus occupies the position shown in FIG. 1. The shaft 17 is placed in the slot 34 and the roller 12 and thrust washers 33 are supported in the pocket 13, aft[illegible] which the shaft 17 is moved so that its end with the [illegible]groove 17*a* passes through the bearing block 20 in [illegible]ess 14, a thrust washer 33, the roller 12 in the pocket 13, the other thrust washer 33, the bearing block 20 in the recess 16 and thence into the slot 37. The capscrews 35, 36 and 38 are then threaded into the reamer body 11, thereby completing the assemblage of the one roller 12: the other rollers 12 are equally readily assembled to complete the roller reamer 10.

To effect disassembly, the steps are reversed, including the removal of the capscrews 35 and 36, the withdrawal of the shaft 17 first into the slot 34, after which it is removed from the reamer body 11. The roller 12, being free of the shaft 17, is also removed, since it may merely drop out of the pocket 13 along with thrust washers 33. The bearing blocks 20 are then removed by rotating them through ninety degrees and passing them through the entryways 14*a* and 16*a*, and then removing them from the pocket 13. Disassembly is relatively easy, since there are no friction or interference fits, all of the fits being clearance fits, or sliding fits in the case of the roller 12 and shaft 17.

In operation, the interengagement provided by the flanges and undercuts prevent outward movement of the bearing blocks 20 under the influence of centrifugal forces. Due to the cylindrical, mating relationship between the bearing blocks 20 and the mating recesses 14 and 16, the bearing blocks 20 may not move axially from the recesses 14 and 16. Further, because the shafts 17 extend through the opening 21 in each of the bearing blocks 20, the bearing blocks 20 are prevented from rotating from the position shown in FIG. 1. By this construction, therefore, the entire assemblage of the bearing blocks 20, roller 12 and shaft 17 are securely held in the reamer body 11 during operation, while at the same time assembly and disassembly are readily effected.

The foregoing disclosure and description of the invention are illustrative and explanatory thereof, and various changes in the size, shape and materials as well as in the details of the illustrated construction may be made without departing from the spirit of the invention.

I claim:

1. In a roller reamer in which a reamer body is provided with at least one pocket, a roller in said pocket journalled on a shaft, and a pair of bearing blocks each having a shaft opening therein for supporting said shaft;

a recess in said body at each end of said pocket having a width transversely of said shaft greater than the length thereof along said shaft;

each said bearing block being in a said recess and each having a width transversely of said shaft and length along said shaft respectively substantially the same as the width and length of said recess;

interengaging means on said body and said bearing blocks for preventing movement of said bearing blocks outwardly of said reamer body; and means for permitting placement of each said bearing block in a said recess comprising an entryway in said reamer body in communication with said recess having a width substantially the same as the length of said bearing block along the shaft opening therein.

2. The roller reamer of claim 1, wherein said reamer body and said bearing block have a clearance fit.

3. The roller reamer of claim 2, said recess and said bearing block having cylindrical ends at their widths of substantially the same radius.

4. The roller reamer of claim 1, said recess and said bearing block having cylindrical ends at their widths of substantially the same radius.

5. The roller reamer of claim 1, and further comprising means for preventing rotation of said shafts.

6. The roller reamer of claim 5, said rotation preventing means comprising means secured in said body engaging said shaft and extending radially thereof.

7. The roller reamer of claim 6, said shaft having a radial groove in an end thereof, said rotation preventing means comprising a screw.

8. The roller reamer of claim 1, said shaft extending axially beyond said bearing blocks, a radial groove in each end of said shaft, and a screw in each said radial groove and threaded into said reamer body.

9. The roller reamer of claim 8, and a third screw threaded into said reamer body adjacent one said screw in a position to be engaged by an end of said shaft upon breakage or loss of said adjacent screw and axial movement of said shaft.

10. A roller reamer for an earth boring tool comprising:

(a) an elongate reamer body having reamer pockets therein and bearing block recesses at the ends of said reamer pockets, (b) an entryway between each said recess and said pocket narrower than said recess, (c) rollers in said pockets, (d) shafts for rotatably supporting said rollers, (e) a bearing block located in each said recess, and having a shaft opening therein, (f) said recesses and said bearing blocks having mating segmental cylindrical surfaces for permitting rotational movement of each said bearing block in a said recess about an axis extending substantially radially of said reamer body, (g) said shaft extending in said shaft opening in said bearing blocks for supporting said roller and preventing rotation of said bearing blocks in said recess, and (h) interengaging means on said reamer body at each said recess and on said bearing blocks for preventing outward radial movement of said bearing blocks.

11. The roller reamer of claim 10, said bearing block and the portions of said reamer body forming said recess and the interengaging means thereon having a clearance fit.

12. The roller reamer of claim 10, said bearing blocks each having a length along the axis of said shaft opening therein no greater than said entryway.

13. The roller reamer of claim 10, and further comprising means for preventing axial movement of said shafts.

14. The roller reamer of claim 13, said last mentioned means comprising screws engaging said shafts and threaded into said reamer body.

15. The roller reamer of claim 14, at least one end of each of said shafts having a transverse groove, a said screw extending into said groove.

16. In a roller reamer comprising a reamer body, a pocket for a roller in said body, a roller in said pocket, a shaft journalling said roller, a recess at an end of said pocket, a bearing block in said recess, said bearing block having a shaft opening therein and said shaft extending into said shaft opening, the improvement comprising:

(a) an entryway communicating said roller pocket and said recess, (b) said recess having a width transverse of said shaft 'eater than said entryway and having segmental lindrical walls concentric with an axis extending ›stantially radially of said reamer body, and (c) said bearing block having segmental cylindrical surfaces in mating relation with said segmental cylindrical walls of said recess and having a length along with axis of said shaft opening not in excess of the width of said entryway, whereby said bearing block may be moved through said entryway in a position with the shaft opening transverse to the shaft receiving position into said recess and then rotated to place the opening into shaft receiving position.

17. The roller reamer of claim 16, and further comprising means on said bearing block and said reamer body for preventing radial outward movement of said bearing block.

18. The roller reamer of claim 17, said reamer body and said bearing block having a clearance fit.

19. The roller reamer of claim 17, and means for preventing axial movement of said shaft.

20. The roller reamer of claim 17, and means on said bearing block for rotating said bearing block on the axis of said segmental cylindrical surfaces.

* * * * *